United States Patent [19]

Haines et al.

[11] Patent Number: 5,020,295

[45] Date of Patent: Jun. 4, 1991

[54] CLADDING LAYER

[75] Inventors: Neil R. Haines, Daisy Hill; Kim Morgan, Mount Eliza, both of Australia

[73] Assignee: John Lysaght (Australia) Limited, Sydney, Australia

[21] Appl. No.: 569,505

[22] Filed: Aug. 20, 1990

Related U.S. Application Data

[63] Continuation of Ser. No. 362,777, Jun. 7, 1989, abandoned.

[30] Foreign Application Priority Data

Jun. 8, 1988 [AU] Australia ..... PI8693
Feb. 17, 1989 [AU] Australia ..... PJ2795

[51] Int. Cl.[5] ..... E04C 2/32
[52] U.S. Cl. ..... 52/630
[58] Field of Search ..... 52/630, 336, 537, 536, 52/538

[56] References Cited

U.S. PATENT DOCUMENTS

| | | | |
|---|---|---|---|
| 433,217 | 7/1890 | Sagendorph | 52/537 |
| 2,812,730 | 11/1957 | Hermann | 52/630 X |
| 2,942,701 | 6/1960 | Pope | 52/630 X |
| 3,466,831 | 9/1969 | Lenoir | 52/537 |
| 3,990,206 | 11/1976 | Reusser | 52/537 |
| 4,074,495 | 2/1978 | Bodnar | 52/630 |

FOREIGN PATENT DOCUMENTS

| | | | |
|---|---|---|---|
| 0279798 | 8/1988 | European Pat. Off. . | |
| 2427 | 1/1878 | Fed. Rep. of Germany | 52/537 |
| 1050536 | 12/1966 | United Kingdom . | |

*Primary Examiner*—Henry E. Raduazo
*Attorney, Agent, or Firm*—Armstrong, Nikaido, Marmelstein, Kubovcik & Murray

[57] ABSTRACT

A coated steel roof cladding panel comprises upwardly projecting, inverted channel, edge and stiffening ribs with essentially flat pans between the ribs. At or near each junction of a rib and panel there is a small bead extending in the same direction as the ribs, and projecting downwardly. If the panel is walked upon after or while being laid on supporting purlins, the beads deform sacrifically and prevent unsightly transverse marks forming in the pans due to flexing of the panel.

6 Claims, 3 Drawing Sheets

CLADDING LAYER

This application is a continuation of application Ser. No. 362,777 filed June 7, 1989.

This invention relates to metal roof cladding panels of the kind which have mutually engageable edge ribs and perhaps similar intermediate stiffening ribs separated by relatively broad, essentially flat pans.

To reduce cost it is customary to make such panels from the thinnest steel or other base metal sheet consistent with the necessary structural strength. This does not reduce the effective life of the panels materially, which is dependent almost entirely on the corrosion resistance of the protective coating applied to the base sheet.

However it sometimes happens when thin panels are walked on, and this inevitably occurs when the panels are being laid, that linear marks appear in the protective and often ornamental coating, apparently produced by the flexing of the panel as a whole between the supporting battens or purlins of the roof structure. The marks are linear and extend from stiffening or edge ribs into the essentially flat pan between the ribs. Tests have shown that the marks in question are not deleterious to the functioning of the panel. Nevertheless they are objected to by many builders and other users, so requiring the replacement of essentially sound panels for cosmetic reasons.

An object of the present invention is to avoid the waste inherent in the replacement of such marked panels.

The invention achieves that object by providing, at or adjacent each junction of a rib and a pan, a bead of small cross-section, referred to as a sacrificial bead hereinafter, extending substantially parallel to the rib and projecting beyond the pan in the opposite direction to the rib.

By way of example, an embodiment of the above described invention is described in more detail hereinafter with reference to the accompanying drawings.

Figure 1:
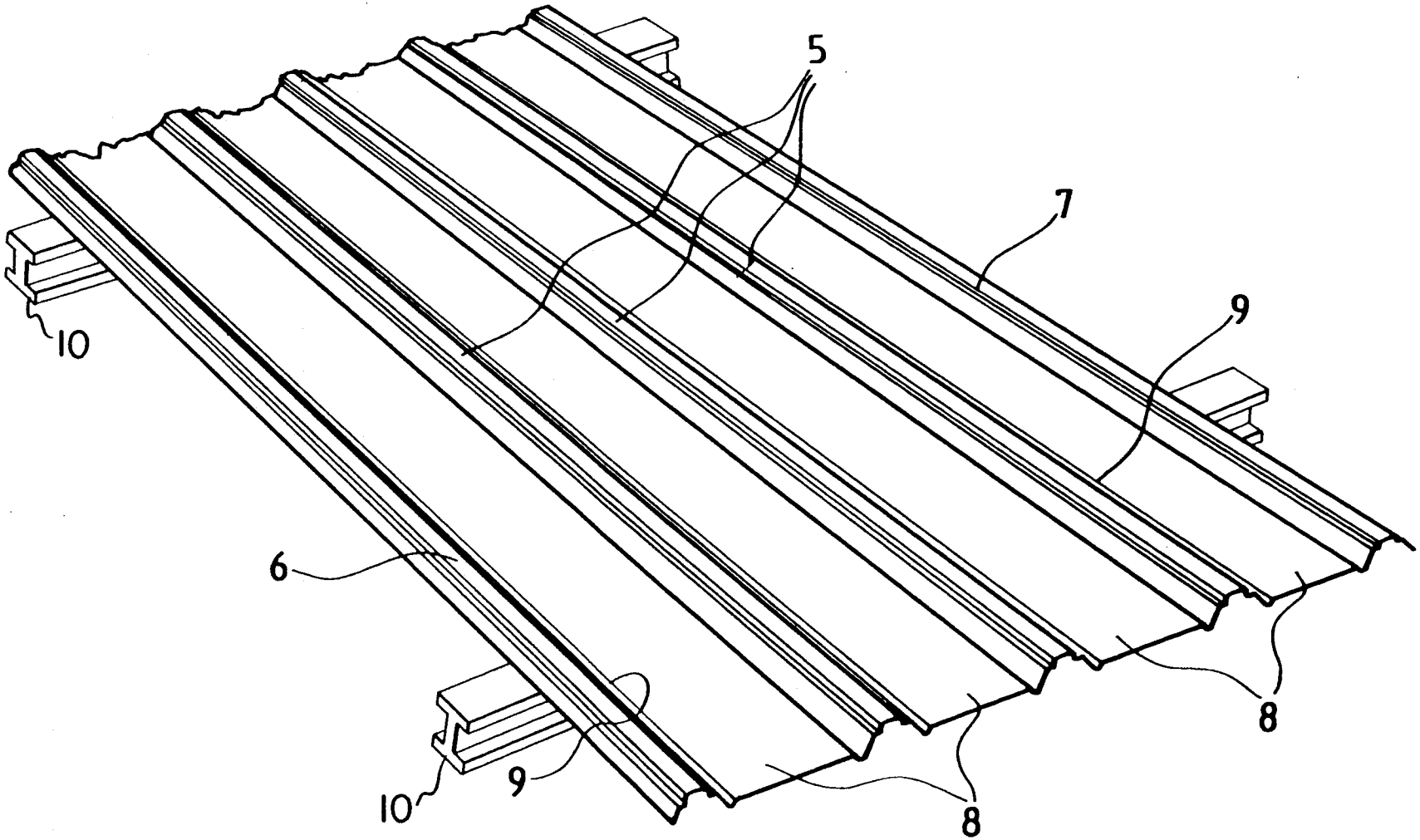
FIG. 1 is a perspective view of a roof cladding panel according to the invention.
Figure 2:
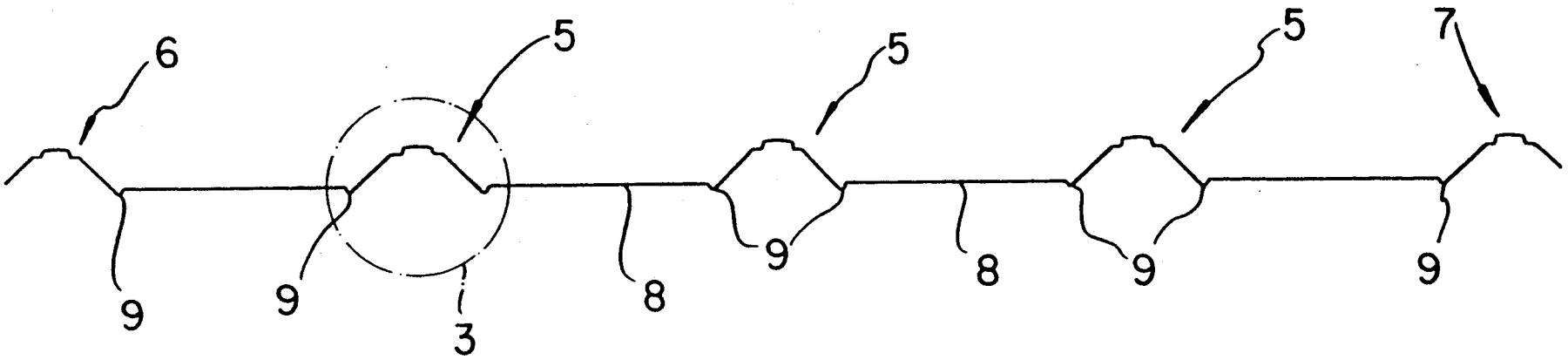
FIG. 2 is a cross-sectional view of the panel of FIG. 1.
Figure 3:
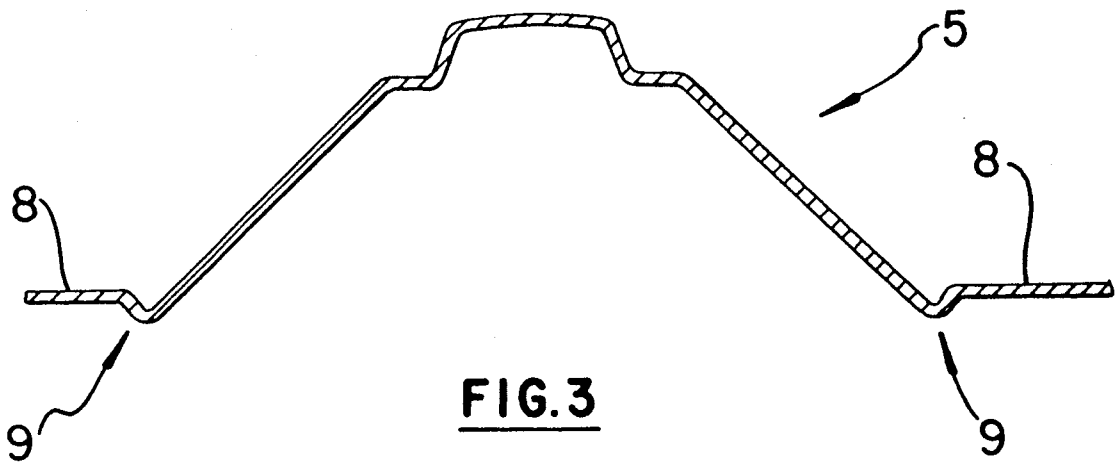
FIG. 3 is an enlarged view of the part of FIG. 2 within the enclosure 3 of that figure.

The roof panel illustrated by FIGS. 1 to 3 may be a coated steel panel and comprises a plurality of inverted channel stiffening ribs 5, inverted channel male and female edge ribs 6 and 7 and a plurality of intermediate essentially flat pans 8. The panel is supported on purlins 10.

Insofar as the foregoing features 5 to 8 are concerned the illustrated panel is conventional, but in accordance with the invention it also comprises a plurality of sacrificial beads 9, disposed one at each junction of a pan S and a rib 5, 6 or 7 as the case may be. The beads 9 are very much smaller than the ribs and project from the pans in the opposite direction to the ribs.

For example, the illustrated panel may be made from a steel sheet 0.42 mm. thick and the sacrificial beads 9 may be substantially semi-circular in cross section with an inner radius of say 1.5 mm.

When the panel is laid upon a batten, purlin or like support, the beads 9 project downwardly and ensure that any high pressure contact between panel and support is substantially limited to the contact between the support and the bead.

It has been found that when a panel according to the invention is overloaded, as by being heavily walked upon, the crests of its beads may be deformed at the edges of the supports but no further damage or marking occurs; thus it would appear that this sacrificial deformation of the bead protects the remainder of the panel. Whether that be the reason or not, it has been found that the presence of the beads has the effect of preventing the objectionable marking of the pans. Furthermore any deformation of the beads that may occur is not in itself objectionable as it does not affect the functioning of the panel and is normally not noticeable to a casual observer.

Figure 4:
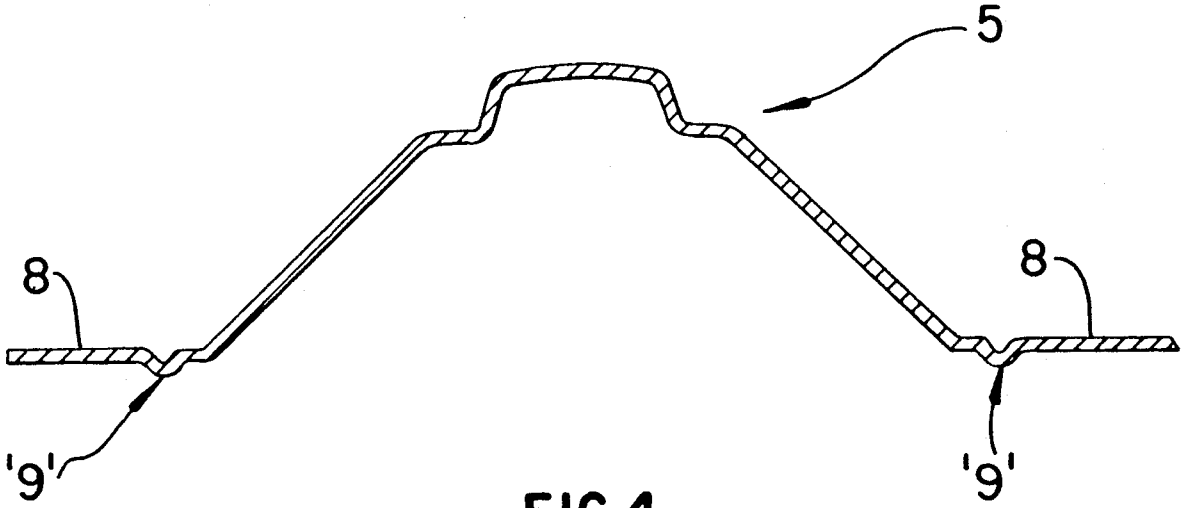
FIG. 4 is a view similar to FIG. 3 of a second embodiment of the invention.

The FIG. 4 embodiment is the same as the above described embodiment except that its sacrificial beads 9' are formed in the pans near to, but nevertheless spaced from, their junctions with the ribs. That is to say the beads 9' are adjacent the junctions rather than at the junctions. It has been found that the beads may be as far as 20 mm from the ribs without affecting their effectiveness in protecting the pans from marking as aforesaid.

The claims defining the invention are as follows;

We claim:

1. A metal rood cladding panel having a protective or ornamental coating and intended for attachment to a supporting surface, the panel being formed of light gauge metal such that, if a panel is overloaded as when an installed panel is walked on, pans therein tend to deform causing formation of stress-reduced marks, said panel comprising:

an essentially flat pan extending in a plane longitudinally of said panel;

two ribs extending longitudinally of said panel wherein one of each said ribs is located on a longitudinal edge of said pan, each said rib and said pan being connected along a longitudinal junction and each said rib being substantially narrower than said pan; and a bead along each said junction between each said rib and said pan, each said rib and said bead projecting from said pan in opposite directions relative to each other such that each said rib projects in an upward direction above the plane of said pan and each said bead projects in a downward direction below the plane of said pan;

said beads being of a small cross-section relative to said ribs such that said beads tend to form when the panel is overloaded to thereby minimize formation of stress-induced marks in the coating on the pan of the panel.

2. A metal roof cladding panel according to claim 1 wherein each said bead is within 20 mm of its adjacent junction.

3. A metal roof cladding panel according to either claim 1 or 2 wherein each said bead is of substantially semi-circular cross-section.

4. A metal roof cladding panel according to claim 1 wherein the metal is steel substantially 0.42 mm thick and each said bead has an inner radius of substantially 1.5 mm.

5. A metal roof cladding panel having a protective or ornamental coating, the panel being formed of light gauge metal intended for attachment to a supporting surface, wherein an installed panel is subject to formation of stress-induced marks in said coating when overloaded, said panel comprising:

an essentially flat in a plane extending longitudinally of said panel;

two ribs extending longitudinally of said panel wherein one of each of said ribs is located on a longitudinal edge of said pan, each said rib being substantially narrower than said pan and being connected to said pan along a longitudinal junction;

a bead along each said junction between said rib and said pan, each said rib and said bead projecting from said pan in opposite directions relative to each other such that said rib projects in an upward direction above the plane of said pan and said bead projects in a downward direction below the plane of said pan to be in contact with said supporting surface;

said bead being of a small cross-section relative to said rib, the light gauge metal of said panel tending to deform in an area of said bead when said panel is overloaded to thereby minimize formation of stress-induced marks in said coating on an area of said pan.

6. A metal roof cladding panel according to claim 5 wherein said cladding is substantially planar so as to be attached in contact with a substantially planar supporting surface.

* * * * *

UNITED STATES PATENT AND TRADEMARK OFFICE

CERTIFICATE OF CORRECTION

PATENT NO. : 5,020,295

DATED : June 4, 1991

INVENTOR(S) : Neil R. HAINES et al

It is certified that error appears in the above-identified patent and that said Letters Patent is hereby corrected as shown below:

In Claim 1, Column 2, Line 27, change " rood " to -- roof --.

In Claim 1, Column 2, Line 33, change " stress-reduced " to -- stress-induced --.

In Claim 1, Column 2, Line 51, change " form " to -- deform --.

Signed and Sealed this

Nineteenth Day of July, 1994

*Attest:*

Bruce Lehman

BRUCE LEHMAN

*Attesting Officer*

*Commissioner of Patents and Trademarks*